United States Patent [19]

Boyce

[11] 4,305,984

[45] Dec. 15, 1981

[54] OVERHANGING BARRIER FIN WEATHERSTRIP AND METHOD OF MANUFACTURE

[75] Inventor: Jay E. Boyce, Honeoye Falls, N.Y.

[73] Assignee: Schlegel Corporation, Rochester, N.Y.

[21] Appl. No.: 128,196

[22] Filed: Mar. 7, 1980

[51] Int. Cl.[3] ..... D04H 11/00; E06B 7/22

[52] U.S. Cl. ..... 428/85; 49/475; 49/489; 156/72; 428/88; 428/92; 428/97

[58] Field of Search ..... 49/475, 489; 428/85, 428/92, 97, 88; 156/72

[56] References Cited

U.S. PATENT DOCUMENTS 3,175,256 3/1965 Horton ..... 49/489

3,266,190 8/1966 Jackson ..... 49/489

*Primary Examiner*—Marion McCamish

*Attorney, Agent, or Firm*—Cumpston & Shaw

[57] ABSTRACT

An overhanging barrier fin weatherstrip and method having a backing strip, and one surface of a sealing body affixed thereto with the opposite surface free. The backing strip and sealing body form a sealing assembly. An inverted shallow V-shaped barrier fin is provided having first and second web portions joined together along a common fold line. The barrier fin is arranged with an edge surface of the first web portion secured to the sealing assembly, and the first web portion extending vertically with the fold line substantially at the level of the opposite free surface of the sealing body. The second web portion extends outwardly from the fold line overhanging the opposite free surface of the sealing body.

8 Claims, 10 Drawing Figures

OVERHANGING BARRIER FIN WEATHERSTRIP AND METHOD OF MANUFACTURE

BACKGROUND OF THE INVENTION

1. Field of the Invention

The present invention relates generally to weatherstrips, and more particularly to a weatherstrip having an overhanging barrier fin and method of manufacture.

The overhanging barrier fin is an inverted shallow V-shaped member having first and second web portions joined along a common fold line. The barrier fin is arranged with the first web portion extending substantially vertically, and the second web portion overhanging the sealing body of the weatherstrip.

2. Description of the Prior Art

It is well known to provide a weatherstrip having rows of pile extending longitudinally from a flexible backing strip, and having a substantially impervious barrier fin comprising a thin film or sheet of plastic material secured to the strip and/or the pile. The fin supplements the sealing action of the pile by increasing the resistance to the infiltration of foreign material such as air, moisture or the like through the weatherstrip. An example of this weatherstrip construction is shown in U.S. Pat. No. 3,175,256.

It is also known to locate the barrier fin on one side of the body of pile as shown in U.S. Pat. No. 3,404,487, or on both sides of the pile as shown in U.S. Pat. No. 3,266,190.

It is further known to provide a barrier fin in which the free edge of the fin extends beyond the free end portions of the sealing body adjacent thereto. In use, the free edge of the fin is bent over at least a part of the free end portion of the sealing body. This weatherstrip construction is disclosed in U.S. patent application Ser. No. 042,999, now U.S. Pat. No. 4,214,930, by A. J. Burrous and which is assigned to the same assignee of the present invention.

One of the major problems with weatherstripping containing barrier fins is an increase in the break-away force required to open a sliding member such as a door or window. The break-away force is the force required to overcome the inertia of the door or window when starting to open it from a fully closed position. The fin tends to snap over or reverse itself as the sliding door or window is moved from a fully closed position, thereby increasing the resistance to such movement to the point that the break-away force required to open a door or window has become excessive. Hence, small children or elderly persons often cannot open the doors or windows having such weatherstripping.

Another problem with weatherstripping containing conventional barrier fin is some leakage of air and moisture past the fin in those situations where the entire fin does not bend in the same direction for some reason or other. In such situations, normally alternate longitudinally and vertically extending portions of the fin will be bent laterally in one direction while the alternate portions therebetween are bent laterally in the opposite direction. The result is a vertical displacement of the upper edge of the fin from the sliding surface of the door or window forming a clearance or space at the node between each pair of oppositely bent portions through which air and moisture can pass.

Still another problem encountered in the use of conventional weatherstripping containing a conventional barrier fin is improper sealing between the upper edge of the substantially vertically extending fin and the sliding surface in engagement therewith where the sliding surface is not entirely smooth, i.e., has an undulating or wavy surface.

These and other problems are solved or minimized by the overhanging barrier fin weatherstrip of this invention.

SUMMARY OF THE INVENTION

In accordance with a preferred embodiment of this invention, an overhanging barrier fin weatherstrip and method of manufacture is disclosed in which the weatherstrip has a conventional longitudinally extending backing strip. Also, a conventional longitudinally extending sealing body has one edge surface attached to the backing strip and its opposite free edge surface projecting from the backing strip. The weatherstrip further has a longitudinally extending barrier fin having at least a portion thereof of a substantially inverted shallow V-shaped cross section having first and second web portions joined together along a common fold line. One edge of the first web portion opposite the fold line is secured to the backing strip or sealing body, and the first web portion extends substantially vertically from the backing strip substantially to the level of the free edge surface of the sealing body. The second web portion extends from the fold line in a direction wherein it substantially overhangs the free edge surface of the sealing body.

In another aspect of the invention, the barrier fin has a third web portion integral with and extending at an obtuse angle from the normally free edge of the second web portion toward the sealing assembly.

The aforementioned invention in all of its aspects is believed to solve or minimize the problems of prior art weatherstrips. This is achieved by, among other things, eliminating reversal or snap-over of the fin when the direction of movement of the sliding member is reversed. This results in lowering the breakaway force required to open a door or window. Also, the invention increases the sealing ability of the weatherstrip by preventing bending of a vertically extending fin in opposite lateral directions forming air and moisture leakage cracks at the node between oppositely bent fin portions. In addition, the invention increases the sealing ability of the weatherstrip by increasing the contact area between the fin and member in sliding engagement therewith. Since in this invention it is the side of the web-like fin that engages the member, and the fin is extremely flexible sidewise, it is able to sealingly engage the entire undulating or wavy surface of the member to provide better sealing.

The invention and its advantages will become more apparent from the detailed description of the invention presented below.

BRIEF DESCRIPTION OF THE DRAWINGS

The details of the invention will be described in connection with the accompanying drawings, in which.

DETAILED DESCRIPTION OF THE INVENTION

Figure 1:
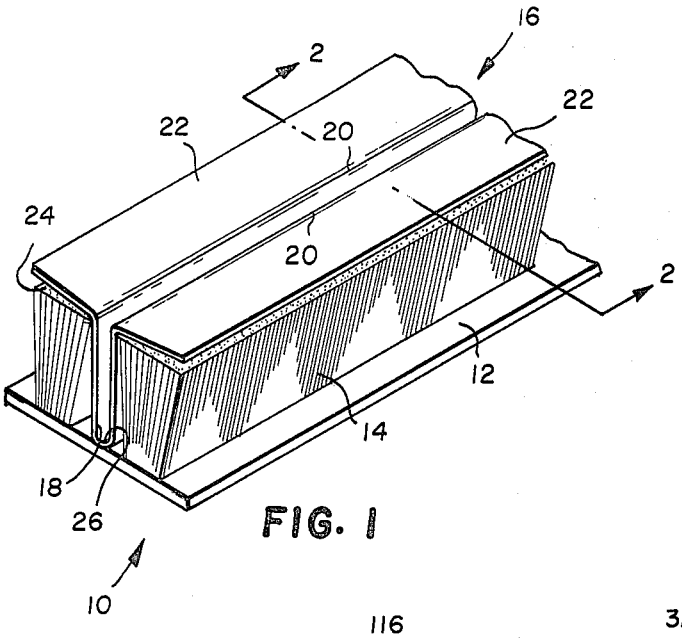
FIG. 1 is a perspective view of a weatherstrip embodying the present invention.
Figure 2:
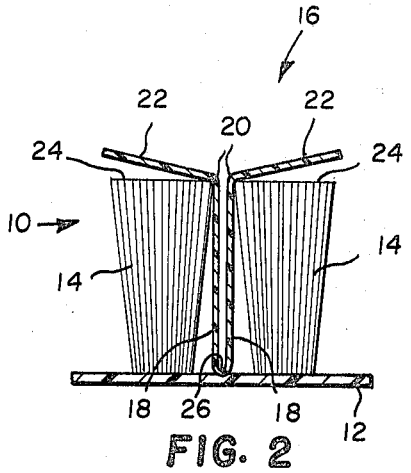
FIG. 2 is a section view of the weatherstrip of FIG. 1 taken substantially along line 2—2.

Referring now to FIGS. 1 and 2 of the drawings, a preferred embodiment of the weatherstrip of the invention is generally designated at 10. The weatherstrip comprises a backing or base strip 12 which in one of its forms is woven of textile fibers, either natural or synthetic, as is well known in the art. Backing strip 12 preferably has formed thereon sealing bodies 14 which in one form comprises upstanding resilient long pile fibers which may be either cut or left uncut. Such fibers may be of known plastic materials such as polypropylene, nylon, orlon, or may be made of natural fibers such as mohair, goat hair, wool, jute or the like, or any combination thereof. Backing strip 12 is preferably formed by weaving, although the pile fibers may be fixed thereto by mechanical embedments, flocking, tufting or other known methods. Backing strip 12 preferably has its marginal edges extending beyond the pile bodies for ease in mounting the strip as is well known in the art. Backing strip 12 and pile bodies 14 are preferably formed with a narrow longitudinally extending gap or "skip" intermediate the pile bodies, for a purpose which will be described hereinafter.

Backing strip 12 is preferably given a coating of known polymeric material such as polypropylene to protect it against abrasion, to stiffen it, and to facilitate the cutting of the strip without fraying.

A barrier fin 16 is formed from a relatively thin flexible film or sheet of a known organic or inorganic thermoplastic or thermosetting material such as vinyl, nylon, glass fiber fabric coated with vinyl, polypropylene, polyethylene, or any other polymeric material. While barrier fin 16 is preferably of an impervious plastic material, it also can be formed of woven or non-woven or matted material which, while not totally impervious, is substantially impervious to wind and moisture under the conditions to which the weatherstripping is normally subjected.

The barrier fin 16 comprises a U-shaped section having a pair of substantially vertically extending first web portions 18. A second web portion 22 is joined to each first web portion 18 by a common hinge or fold line 20 located substantially at the upper surface of pile 14. Each of the second web portions 22 extend from fold line 20 across the upper edge surface 24 of each sealing body 14 in overhanging relation. Each of the joined first and second web portions 18, 22 respectively further form a substantially inverted shallow V-shaped portion of fin 16. The fin, preferably pre-formed as one unit, is secured adjacent the joined lower edges 26 of first web portions 18 to backing strip 12 along the gap by heat welding, by suitable adhesives or by any other known means as is well understood in the art. Alternatively, the fold lines 20 may be post-formed following the fin securing operation.

Barrier fin 16 may also be secured to the adjacent pile fibers 14 in addition to or instead of being attached to strip 12, as is well known in the art. Barrier fin 16 is thus resiliently supported by strip 12 and/or pile 14 referred to as the sealing assembly, and serves to increase the resistance of the weatherstrip 10 to wind, rain or other foreign material that might otherwise penetrate the weatherstrip.

Figure 3:
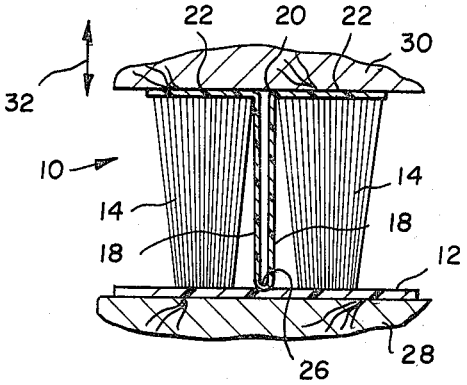
FIG. 3 is a fragmentary view in section showing the weatherstripping in sealing position between two relatively movable members.

Referring to FIG. 3, the weatherstrip 10 shown in FIGS. 1 and 2 is affixed by known means to one of relatively movable members 28, 30 which are to be sealed by the weatherstripping. The members 28, 30 may be portions of a window, door, joint or the like. The aligned members 28, 30 have been moved vertically in the direction of the arrows 32 into a closed position, and the weatherstripping is in a compressed or sealing position.

Figure 4:
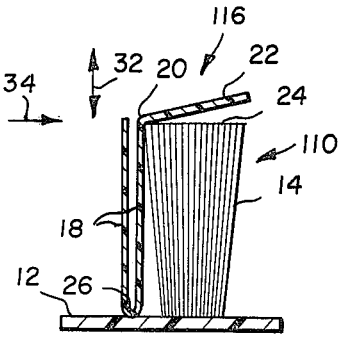
FIGS. 4–10 are section views of modified embodiments of the weatherstrip.

While it is preferably to provide sealing bodies 14 of pile fibers on each side of barrier fin 16 as is shown in FIGS. 1–3, it is sufficient for certain installations to provide only a single body of pile fibers 14 on one side of a segment of a fin 16. Such a construction is shown in FIG. 4 in which the fin 16 is denoted by the same numeral plus 100. In this construction, horizontal or vertical movements of a member, such as member 30 in FIG. 3, in the direction of the arrows 32, 34 folds or bends web portion 22 of fin 16 over the upper edge surface 24 of pile fibers similar to that shown at the right portion of FIG. 3.

With reference to FIGS. 5–10, other embodiments of the weatherstrip 10 of this invention are illustrated. In these figures, parts identical to parts shown in FIGS. 1–3 are denoted by the same numerals, and similar parts are denoted by the same numerals plus a hundred, or two hundred, or three hundred, etc.

Figure 5:
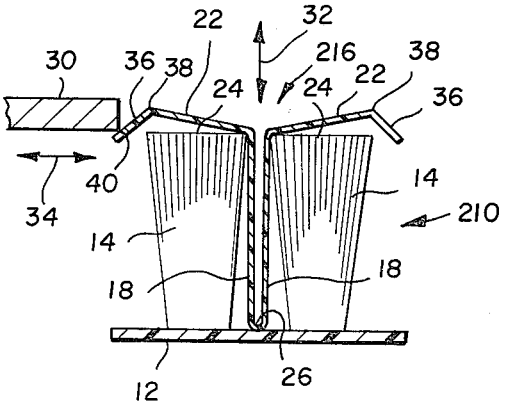

Referring to FIG. 5, barrier fin 216 is provided with third web portions 36 extending downwardly from a common hinge or crease line 38 joining second and third web portions 22, 36 at what is normally the free edge of each second web portion 22. Third web portions 36 each define an obtuse angle with second web portion 22. Web portions 22, 36 further provide cam follower surfaces which when engaged by a corner 40 of a sliding member 30 in either horizontal direction of movement indicated by the arrows 34 will be moved along with the weatherstrip into a sealed position as seen in FIG. 3. This weatherstrip 216 is further suitable for installations in which relative vertical movement of aligned members in the direction of the arrows 32 compresses the weatherstrip into a sealed position as seen in FIG. 3.

Figure 6:
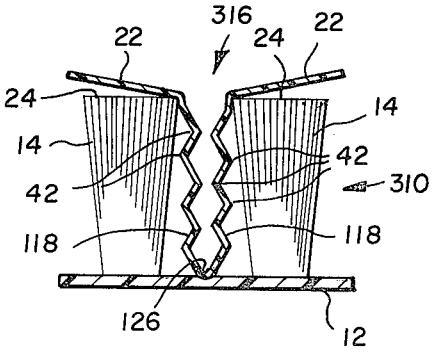
Figure 7:
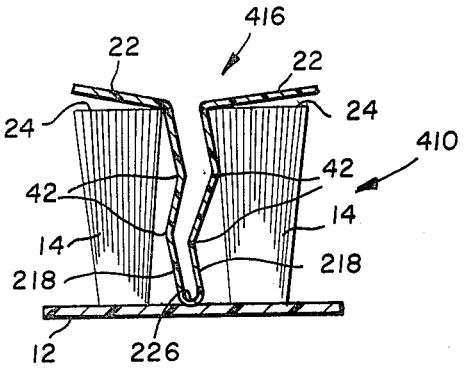

With reference to FIGS. 6 and 7, first web portions 118, 218 respectively are provided with additional hinge or fold lines 42 which may vary in number, and may be symmetrical a non-symmetrical. The hinge lines 42 allow the fin 316, 416 to collapse easily when compressed, and hence reduces the force required to be applied to a door or window for moving it to its closed and sealed position.

Figure 8:
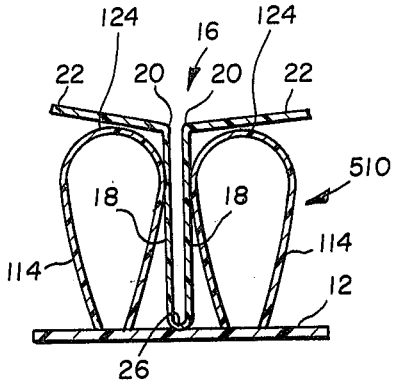
Figure 9:
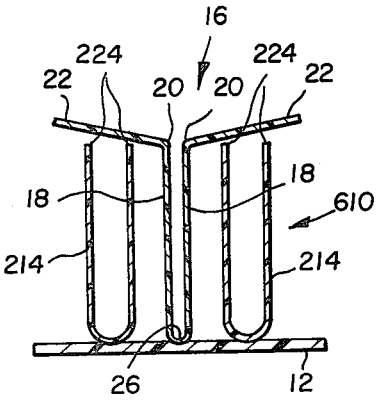
Figure 10:
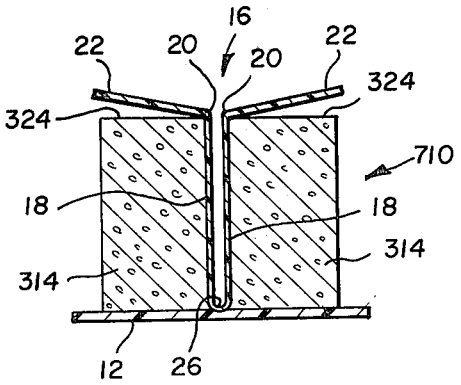

Referring to FIGS. 8–10, different forms of sealing bodies 114, 214 and 314 respectively are illustrated for use in weatherstrips 510, 610 and 710 respectively of this invention. In FIG. 8, the sealing bodies 114 comprise a pair of loop-shaped film members. In FIG. 9, the sealing bodies 214 are illustrated as a pair of U-shaped film members. In FIG. 10, the sealing bodies 314 comprise blocks of resilient material such as sponge rubber or the like of a rectangular cross-section.

While presently preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. An overhanging barrier fin weatherstrip comprising:

a longitudinally extending backing strip;

at least one longitudinally extending sealing body having one edge surface attached to said backing strip and its opposite free edge surface projecting from said backing strip, said backing strip and sealing body cooperating to form a sealing assembly; and a longitudinally extending barrier fin having first and second web portions joined along a common fold line to define an obtuse angle therebetween, said first web portion having one edge, opposite and parallel to said fold line, secured to said sealing assembly, said first web portion further extending substantially vertically from said backing strip to said fold line located substantially at the level of said free edge surface, and said second web portion extending from said fold line in a direction wherein it overhangs said free edge surface of said sealing body.

2. A weatherstrip according to claim 1 wherein at least a pair of sealing bodies are fixed to said backing strip with a gap therebetween, and said fin is located in said gap between said sealing bodies.

3. A weatherstrip according to claim 2 wherein each of said sealing bodies comprises a row of pile.

4. A weatherstrip according to claim 1 wherein said sealing body comprises a row of pile.

5. A weatherstrip according to claim 1 wherein said fin has a substantially U-shaped portion forming said first web portion and having the apex of the U-shaped portion fixed to said backing strip, and said second web portion is integral with and extends at an angle from the other edge of said first web portion and forms said common fold line at the junction thereof.

6. A weatherstrip according to claims 1 or 5 wherein said fin has a third web portion integral with and extending downwardly at an obtuse angle from the free end of said second web portion, and forms a crease line at the junction of said second and third web portions.

7. A method of forming a weatherstrip comprising the steps of:

providing a longitudinally extending backing strip;

affixing one edge surface of a transversely and longitudinally extending sealing body to the backing strip with the opposite edge surface free, the backing strip and sealing body cooperating to define a sealing assembly;

forming a longitudinally extending barrier fin having first and second web portions defining an obtuse angle and joined together along edges thereof to form a common fold line;

affixing an edge of the first web portion located opposite the fold line to the sealing assembly with the first web portion of the fin extending substantially vertically from the sealing assembly adjacent the sealing body with the fold line substantially at the same level as the opposite free edge surface of the sealing body, and with the second web portion extending from the fold line substantially across and overhanging the opposite free edge surface.

8. The method according to claim 7 including the further step of forming a third web portion in the fin along the edge of the second web portion located opposite the fold line and forming a common crease line, and arranging the third web portion to define an included angle between the second and third web portions facing the sealing assembly of less than 180, and to extend downwardly toward the backing strip.

* * * * *